United States Patent [19]

Luyties

[11] Patent Number: 4,854,779

[45] Date of Patent: Aug. 8, 1989

[54] INSTALLATION OF MULTIPIECE JACKETS USING MATING PINS

[75] Inventor: William H. Luyties, Kingwood, Tex.

[73] Assignee: Shell Offshore Inc., Houston, Tex.

[21] Appl. No.: 132,749

[22] Filed: Dec. 14, 1987

[51] Int. Cl.[4] ..... E02B 17/00; E02D 21/00

[52] U.S. Cl. ..... 405/205; 405/195; 405/204; 405/224

[58] Field of Search ..... 405/169, 195, 209, 204, 405/224, 225, 227

[56] References Cited

U.S. PATENT DOCUMENTS

| | | | |
|---|---|---|---|
| 3,545,539 | 12/1970 | Manning | 405/169 X |
| 3,716,994 | 2/1973 | Rogonowski | 405/204 |
| 3,859,806 | 1/1975 | Guy et al. | 405/204 |
| 4,426,173 | 1/1984 | Richart et al. | 405/195 |
| 4,541,755 | 9/1985 | Castel et al. | 405/195 |
| 4,607,982 | 8/1986 | Brasted et al. | 405/204 |
| 4,669,918 | 6/1987 | Riles | 405/227 |

FOREIGN PATENT DOCUMENTS

| | | | |
|---|---|---|---|
| 94509 | 6/1983 | Japan | 405/204 |
| 195966 | 5/1965 | Sweden | 405/204 |

OTHER PUBLICATIONS

"Construction of the Cognac Platform, 1025 Feet of Water, Gulf of Mexico," G. H. Sterling, A. O. P. Casbarian & Assoc., N. L. Dodge, D. C. Godfrey, presented at the 11th Annual OTC, Apr. 30–May 3, 1979, Publication No. OTC 3493.

"Development of an Alignment System for the Three--Part Cognac Platform Jacket," E. S. Piter, Lowell Johnston & Assoc., G. H. Sterling, B. E. Cox, presented at the 11th Annual OTC, Apr. 30–May 3, 1979, Publication No. OTC 3496.

*Primary Examiner*—Dennis L. Taylor
*Assistant Examiner*—John A. Ricci

[57] ABSTRACT

An offshore platform mating system of the present invention is disclosed in which an upwardly open lower receptacle is provided on upper extensions of leg portions of a jacket bottom section of the offshore platform for receiving a mating pin so as to project a docking pole upwardly. Downwardly open upper receptacles are provided on the lower extensions of each leg portion of the corresponding jacket top section and are disposed to receive the upwardly projecting docking pole of the mating pin. A connection is provided for securing the jacket top section to the jacket bottom section. A method is also disclosed for installing the offshore platform utilizing the mating pins.

25 Claims, 5 Drawing Sheets

FIG. 5
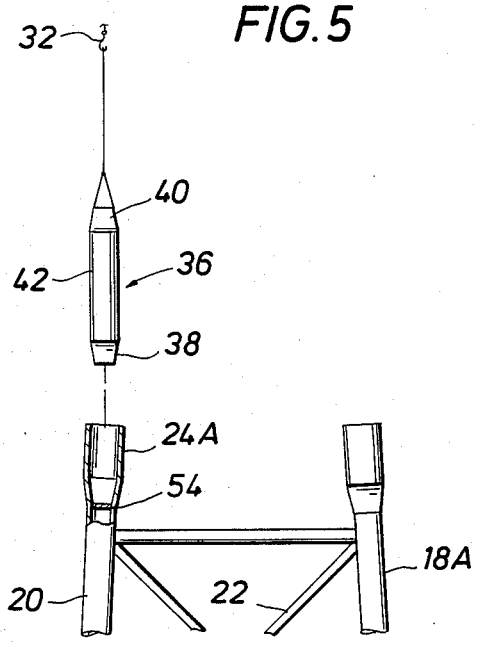
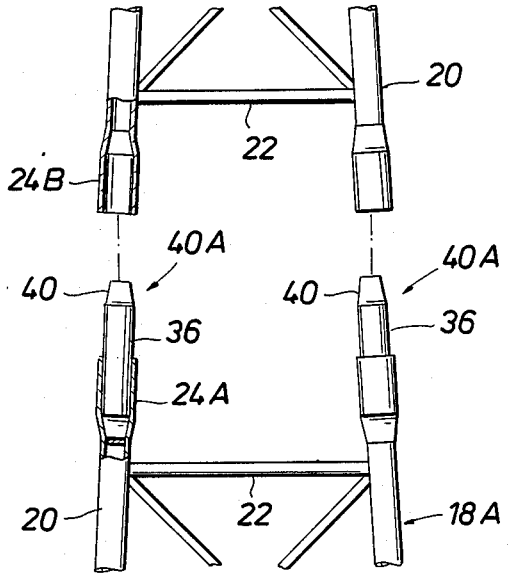
FIG. 6
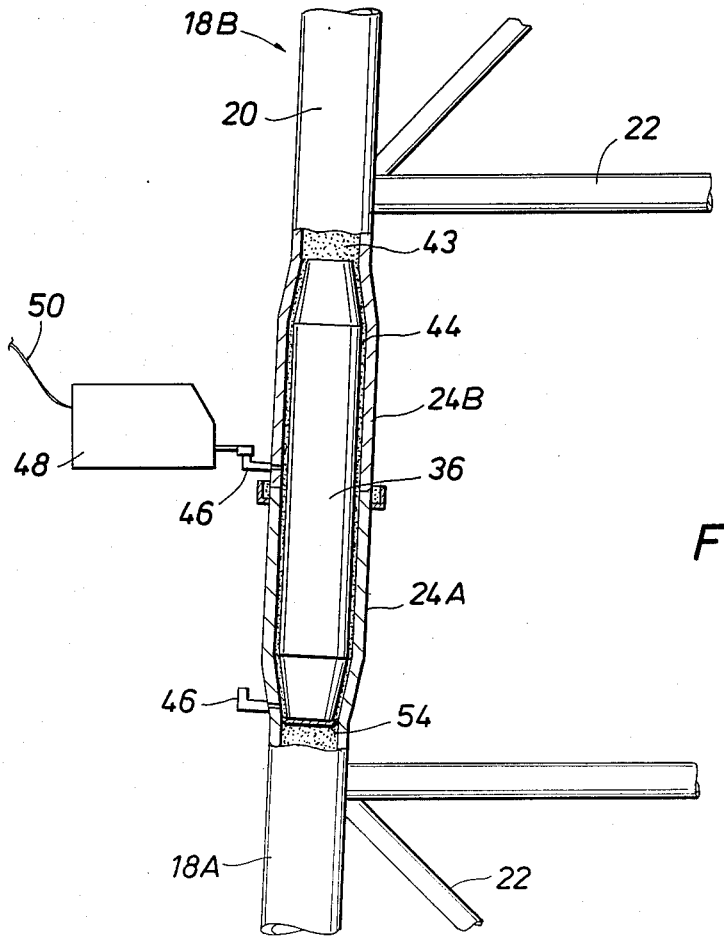
FIG. 7

INSTALLATION OF MULTIPIECE JACKETS USING MATING PINS

BACKGROUND OF THE INVENTION

This invention relates to the installation of an offshore platform of the type used for oil and gas drilling and/or production operations. More particularly, this invention relates to the installation of an offshore platform having a multiplicity of jacket sections, each secured to the adjacent jacket section with a plurality of mating pins, each mating pin securing one joint.

Construction costs for offshore platforms favor onshore construction, with deep water installation providing difficult handling, transportation, launching and upending procedures for placing a prefabricated tower structure at the selected site. Therefore, the use of prefabricated, stackable jacket sections provides an alternative responsive to both onshore construction costs and offshore transportation, handling and installation costs. However, multipiece jacket installations require that the respective jacket sections or stages be mated at installation and securely interconnected. In the past, the jacket sections have been connected with long pins inserted from the surface of a fully assembled stack of jacket sections. However, this leaves the entire stack of jacket sections unsecured until length pin installation procedures are complete. Further, any misalignment or other hangup in installations anywhere within the hollow legs jeopardizes the entire pin installation.

Alternatively, it has been proposed to suspend releasable pins within the legs of the platform at each section in a position to drop onto engagement across the joints. However, this system requires complicated support and release systems within the legs and any problems with the release system would likely be remote and inaccessible to the operators.

As another alternative, shore-mounted pins have been proposed for presentation on the bottom of each upper jacket section or on the top of each lower jacket section, but this produces its own handling problems and any damage to the pins protruding from one of the jacket sections while mating with the adjoining jacket section would require costly reworking of the jacket section and significant and costly time delays.

Clearly there is a need for simpler techniques and apparatus for joining prefabricated multipiece jacket sections into offshore platforms.

SUMMARY OF THE INVENTION

It is therefore an object of the present invention to provide a system and method of installing an offshore platform from multipiece jacket sections which balances onshore construction capabilities with ease of offshore installation while minimizing the vulnerability of the offshore platform during installation.

Another object of the present invention is to provide a system and method of offshore installation of an offshore platform from multipiece jacket sections which facilitates alignment during mating procedures.

It is a further object of the present invention to provide a system for joining offshore sections which will minimize time delays if there is any damage to adjoining elements during mating procedures.

Finally, it is an object of the present invention to provide pin installation in such a manner that they are accessible to remotely operated vehicle (ROV) or divers in the event of problems requiring pin removal.

Toward the fulfillment of these and other objects according to the offshore platform mating system of the present invention, an upwardly open lower receptacle is provided on upper extension of each leg of the jacket bottom section of the offshore platform which will receive a mating pin so as to project a docking pole upwardly. Downwardly open receptacles are provided on the lower extensions of each leg of the corresponding jacket to section which are disposed to receive the upwardly projecting docking pole of the mating pin. Finally, means are provided for securing the jacket top section to the jacket bottom section, preferably by grouting about the mating pins within the upper and lower receptacles.

In another aspect of the invention, a method is provided for assembling an offsore platform upon the ocean floor in which a jacket bottom section is secured to the ocean floor in a manner presenting a plurality of substantially vertical lower receptacles on the tops of the leg portions of the jacket bottom section. Mating pins are then installed in the upper receptacles in such a manner that each projects a docking pole upwardly from the jacket botom section which receives downwardly open upper receptacles carried on the lower portion of the leg portions of the jacket top section to mate the jacket top section with the jacket bottom section. The assembly continues with the securing of the jacket top section to the jacket bottom section.

In a further aspect of the invention, alignment of adjacent jacket sections is facilitated by using at least one lead pin to present an extended docking pole. The docking pole of the lead pin projects further from the jacket bottom section than do the other mating pins. Thus, the lead pin is the first to engage one of the horizontally aligned downwardly open upper receptacles presented by the descending jacket top section. Lowering procedures for the jacket top section continue with rotational alignment of the jacket top section with the lead pin acting as the pivot while alignment of the other downwardly open upper receptacles is adjusted with respect to the other mating pins.

BRIEF DESCRIPTION OF THE DRAWINGS

The above brief description, as well as further objects, features and advantages of the present invention, will be more fully appreciated by reference to the following detailed description of the presently preferred, but nonetheless illustrative, embodiment of the present invention with reference to the accompanying drawings in which:

FIG. 5 illustrates the installation of a mating pin into the lower receptacle of the jacket bottom section in accordance with the method of the present invention;

FIG. 6 is a side elevational view of the mating of a jacket top section to a jacket bottom section in accordance with the present invention;

FIG. 7 is a partially cross-sectioned side elevational view of a joint of the jacket top section to the jacket bottom section during grouting operations in accordance with the present invention.

DETAILED DESCRIPTION OF THE PREFERRED EMBODIMENTS

Figure 1:
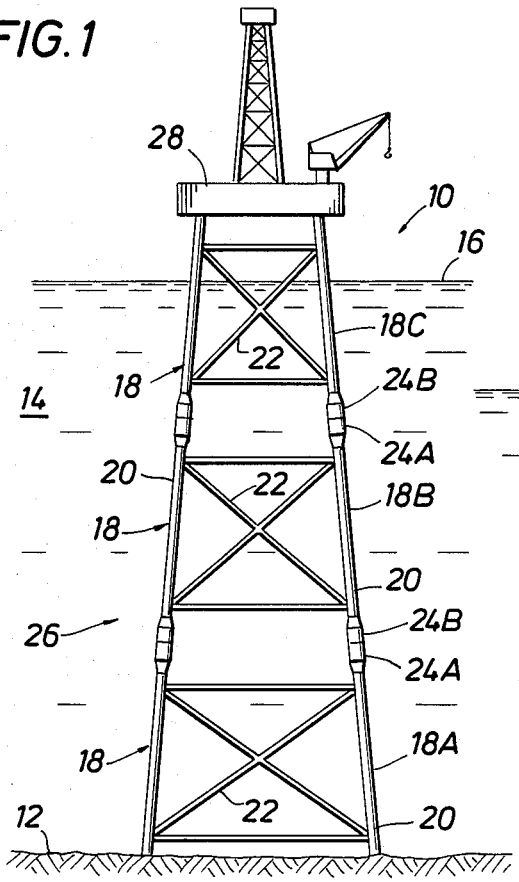
FIG. 1 is a side elevational view of an offshore platform constructed in accordance with the present invention.

Referring to FIG. 1, the reference character 10 refers generally to an offshore platform constructed in accordance with the present invention. The offshore platform is founded upon ocean floor 12 to stand in water 14 so as to project an uppermost section above water surface 16. Offshore platform 10 is supported upon a plurality of jacket sections 18, here designated first-stage or jacket bottom section 18A, second-stage or jacket top section 18B, and third-stage jacket section 18C.

Each jacket section connects a plurality of leg portions 20 with struts and bracing 22 in a formation of prefabricated units. The prefabricated units of the respective jacket sections 18 are joined at corresponding lower and upper receptacles 24A and 24B, respectively, at the joining of constituent leg portions 20 into an overall tower structure 26 which will support a platform 28 for drilling and/or production operations relating to commercial development of hydrocarbon reserves.

Figure 2:
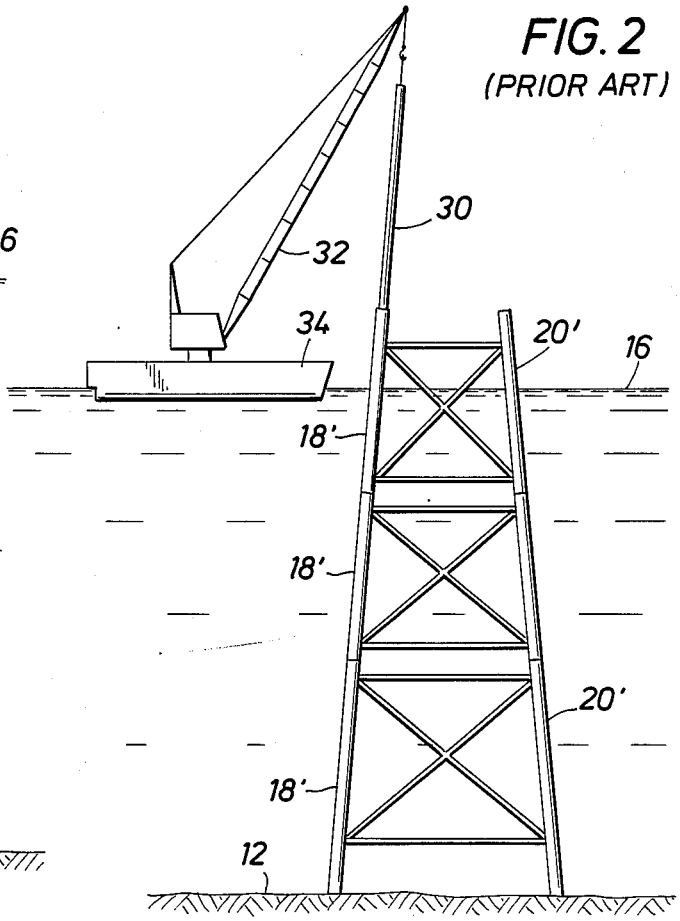
FIG. 2 (PRIOR ART)
FIG. 2 is a side elevational view of multipiece jackets of an offshore platform being joined in accordance with the teachings of the prior art.

Multipiece jacket installation in accordance with the prior art is illustrated in FIG. 2 in which a long pin 30 is lowered throughout the combined length of each leg portion 20′ of a complete stack of jacket sections 18′ starting from access above the surface of water 16 and leading through the top of each of leg portions 20′. Here long pin 30 is shown during lowering procedures aided by crane 32 provided by barge 34.

Figure 2A:
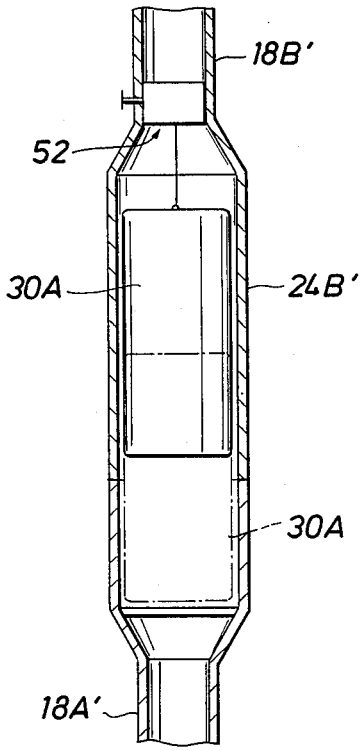
FIG. 2A (PRIOR ART)
FIG. 2A is a cross-sectional side view of another prior art proposal for deploying mating pins in the joining of multipiece jackets into offshore platforms.

An alternative proposed in the prior art to the use of long pins 30 is illustrated schematically in FIG. 2A. In this approach, mating pins 30A are suspended within an upper receptacle 24B′ by a releasable support system ilustrated schematically by support and lowering means 52. The intent of this system is to place a jacket top section 18B′ over a jacket bottom section 18A′ independently of the mating pins, then to release the mating pins 30A from reception within the downwardly open upper receptacles to lower into position across the jacket section interface as illustrated in dotted outline in FIG. 2A. However, support and lowering means 52 are substantially more complicated than illustrated in the schematic and performing this operation with inaccessible pins, after jacket section placement, suggest possible difficulties in deployment.

The advantages of the present invention will be apparent in view of the following disclosure to those of ordinary skill in the art.

Figure 3:
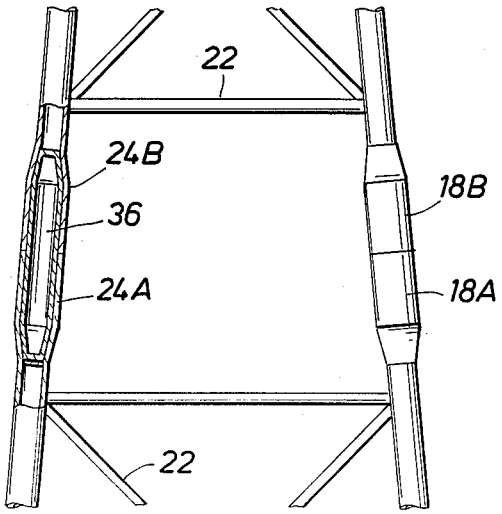
FIG. 3 is a side elevational view in which upper and lower receptacles are partially broken away to illustrate the placement of a mating pin of the present invention.

Returning to the present invention, FIG. 3 provides a cross section illustrating the platform mating system in which first-stage or jacket bottom section 18A is joined to second-stage or jacket top section 18B. A mating pin 36 is illustrated received within both lower receptacle 24A of jacket bottom secton 18A and upper receptacle 24B of jacket top section 18B in the broken-away portion of the figure. Both the upper and lower receptacles are load-bearing members within legs of the assembled platform 10.

Figure 4:
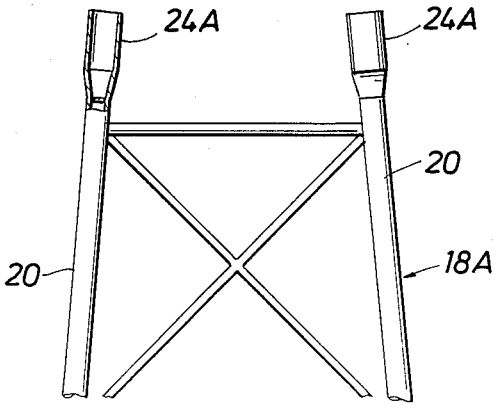
FIG. 4 is a side elevational view, partially broken away at one of the lower receptacles, in which the jacket bottom section has been installed on the ocean floor.

Installation procedures are illustrated in FIGS. 4–7 for one embodiment. FIG. 4 illustrates the jacket bottom section 18A secured to the ocean floor (see FIG. 1). In the preferred embodiment, each of leg portions 20 of the jacket bottom section provides one upwardly open lower receptacle 24A, one of which has been partially cross-sectioned in the referenced figure to better illustrate the open interior. Jacket bottom section 18A is placed and secured to the bottom by conventional means such as piles which are well known in the art.

FIG. 5 illustrates the lowering of mating pin 36 into upwardly open lower receptacle 24A of the jacket bottom section. Mating pins 36 can be lowered by a crane 32 provided conventionally on a barge as illustrated in FIG. 2. In the preferred embodiment, each of mating pins 36 is elongated and substantially cylindrical, terminating in a lower extreme in a downwardly converging conical section 38 and terminating with the upper portion in an upwardly converging conical section 40 on either side of a cylindrical middle shank portion 42. The downwardly converging conical section of mating pin 36 aids an alignment and reception of the mating pin within the lower receptacle of the jacket bottom section. Each of mating pins 36 is lowered into one of the lower receptacles until it rests upon a pin support 54.

FIG. 6 illustrates jacket bottom section 18A following installation of a plurality of mating pins 36, each installed so as to present an upwardly extending, substantially vertical docking pole 40A, which, in the preferred embodiment, terminates in the upwardly converging conical section 40. After each of mating pins 36 is installed within the respective lower receptacles 24A, jacket top section 18B may be lowered by conventional techniques so as to mate upper receptacles 24B onto docking poles 40A. An alternative to lowering by conventional techniques is addressed later in this disclosure. In the preferred embodiment of the pins, upwardly converging conical sections 40 of the mating pins aid in alignment during this docking procedure.

After mating adjacent jacket sections, it is preferred to secure the respective jacket top section to the jacket bottom section at each joint prior to installation of the next succeeding jacket section. In the preferred embodiment, the jacket top section is secured to the jacket bottom section by securing each to pin 36 by injecting a grout 43 into an annular space 44 defined between pin 36 and the surrounding lower and upper receptacles 24A and 24B. Access to annular space 44 may be provided by a port 46 to which a ROV 48 may dock to pump grout 43 from a line 50 into the annular space 44. The grout is allowed to harden and secures the joint.

Figure 8:
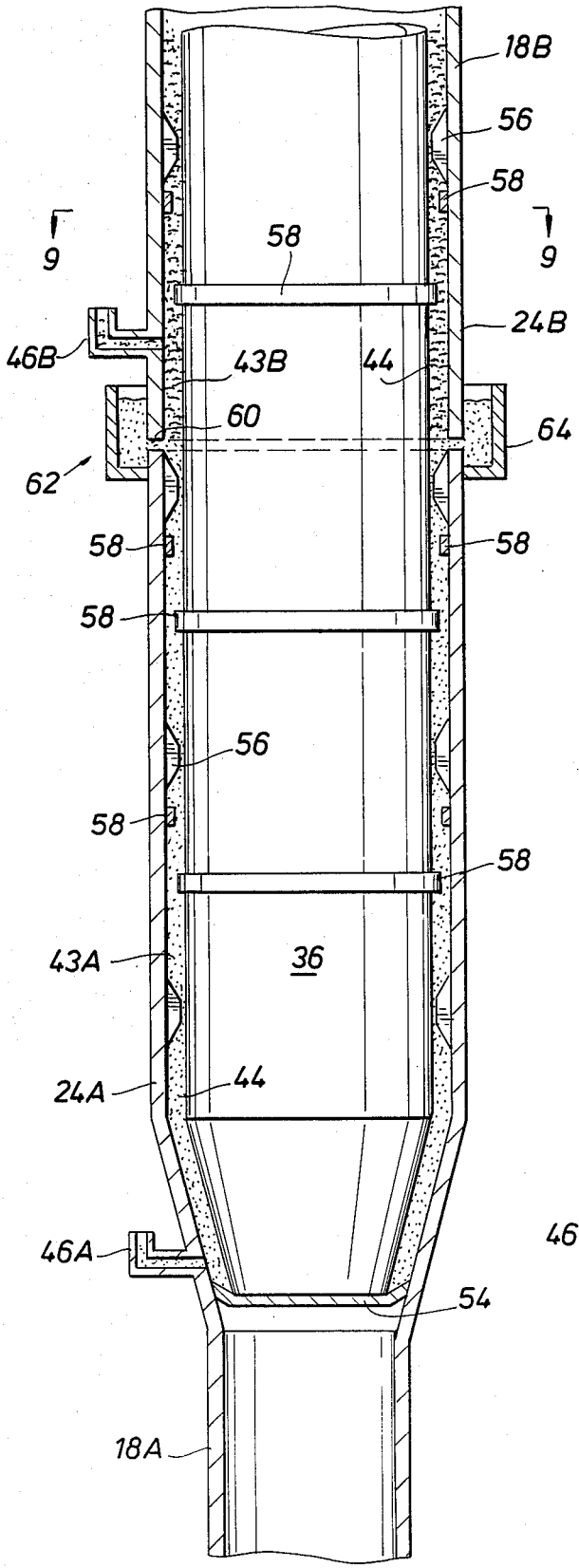
FIG. 8 is a cross-sectional side view detailing the preferred embodiment for securing the jacket top section to the jacket bottom section about the mating pins.
Figure 9:
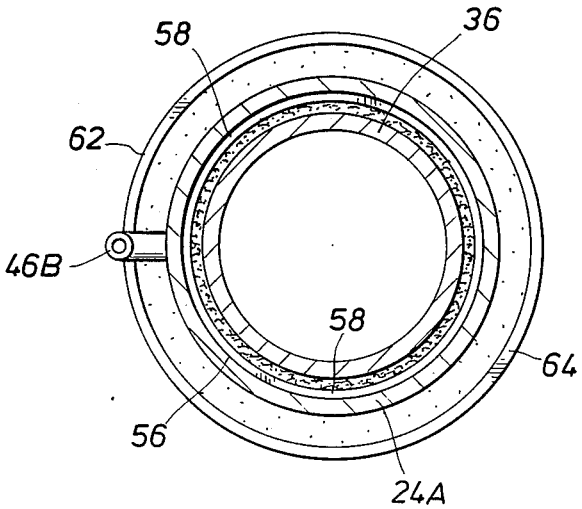
FIG. 9 is a cross-sectional view of the preferred embodiment for securing the jacket top section to the jacket bottom section taken at line 9—9 in FIG. 8.

FIGS. 8 and 9 illustrate in greater detail the means of the preferred embodiment for securing jacket top section 18B to jacket bottom 18A about mating pins 36. A plurality of fins 56 protrude from the inner circumference of both upper receptacle 24B and lower receptacle 24A. Fins 56 cooperate with dropped shoulders on pin support 54 to center mating pin 36 within the joined receptacles. Further, a plurality of shear bars 58 are provided about the exterior circumference of mating pin 36. Additional shear bars 58 are provided on the interior circumference of the upper and lower receptacles. These shear bars provide bearing surfaces within the hardened grout to secure the relative positions of the jacket sections about the mating pins.

FIG. 8 also illustrates evidence of the preferred grouting operations in which grout 43A is first injected into a lower port 46A and pumped up annular space 44 until it leaves the annular space at opening 60 between jacket top section 18B and jacket bottom section 18A. There the grout fills an annular collar, grout pan 62, formed at the top of the upwardly open lower receptacle 24A and extending a lip 64 above opening 60. Port 46A is sealed in accordance with conventional techniques well known in the art and first grout 43A is then allowed to set, including the grout in grout pan 62 which sets to seal opening 60.

A second batch of grout, here referenced 43B, is then injected at port 46B and is pumped up annulus 44 between mating pin 36 and upper receptacle 24B. Injection port 46B is sealed and the grout is allowed to set.

In another aspect of the invention it is desired to relatively shorten all but two pairs of the corresponding, interfacing jacket section members at each stage-to-stage interface. Load distribution across the stage-to-stage interface tends to load primarily across some oppositely disposed pair of legs 20 prior to grouting. This distribution is a result of both the practical tolerances of construction and deformation upon deployment. However, rather than striving to eliminate this essentially inevitable distribution, an embodiment of the present invention seeks to control this phenomenon by selecting the load distribution by deliberately shortening all but two pairs of the interfacing leg portions 20, thereby resulting in somewhat exaggerated gaps between the upper and lower receptacles 24B and 24A, respectively, in a first set of pairs of the corresponding receptacles as illustrated by opening 60 in FIG. 8. This necessarily shifts the load distribution to a second select set of corresponding upper and lower receptacles upon initial touchdown of the jacket top section onto the jacket bottom section.

Depending upon water depth, additional sections such as thirdstage jacket section 18C in FIG. 1 may be sequentially added in like manner, each addition providing a jacket lower section and a jacket upper section relative to the joint. The jacket lower section at each such junction is exemplified by the discussion of jacket bottom section 18A above and the jacket upper section is exemplified by jacket top section 18B.

Figure 10:
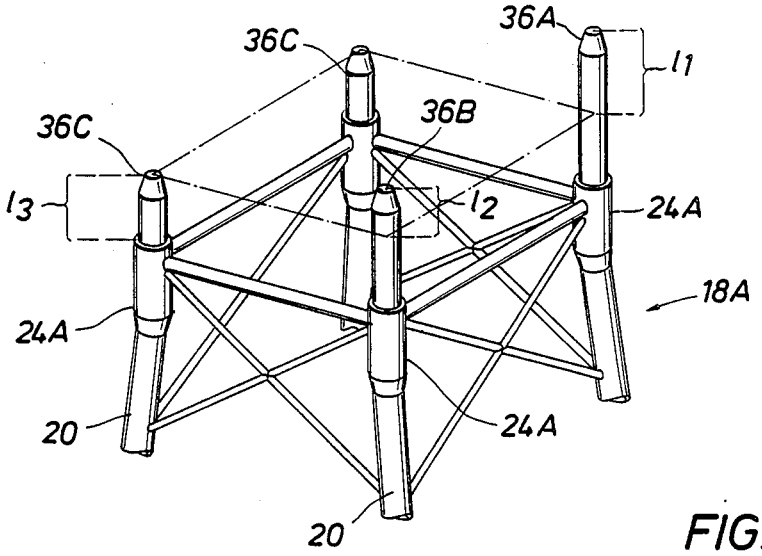
FIG. 10 is a perspective view of a jacket bottom section in which mating pins, including primary and secondary lead pins, have been installed.
Figure 11:
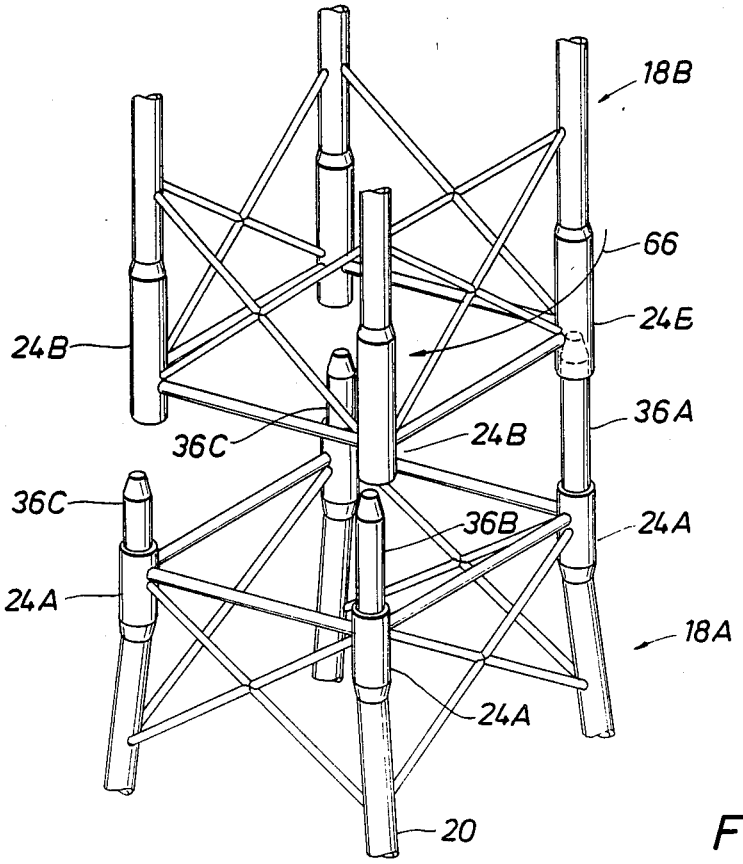
FIG. 11 is a perspective view of the mating of a jacket top section to a jacket bottom section in which the primary lead pin is engaged and the jacket top section is being aligned for mating of the secondary lead pin.
Figure 12:
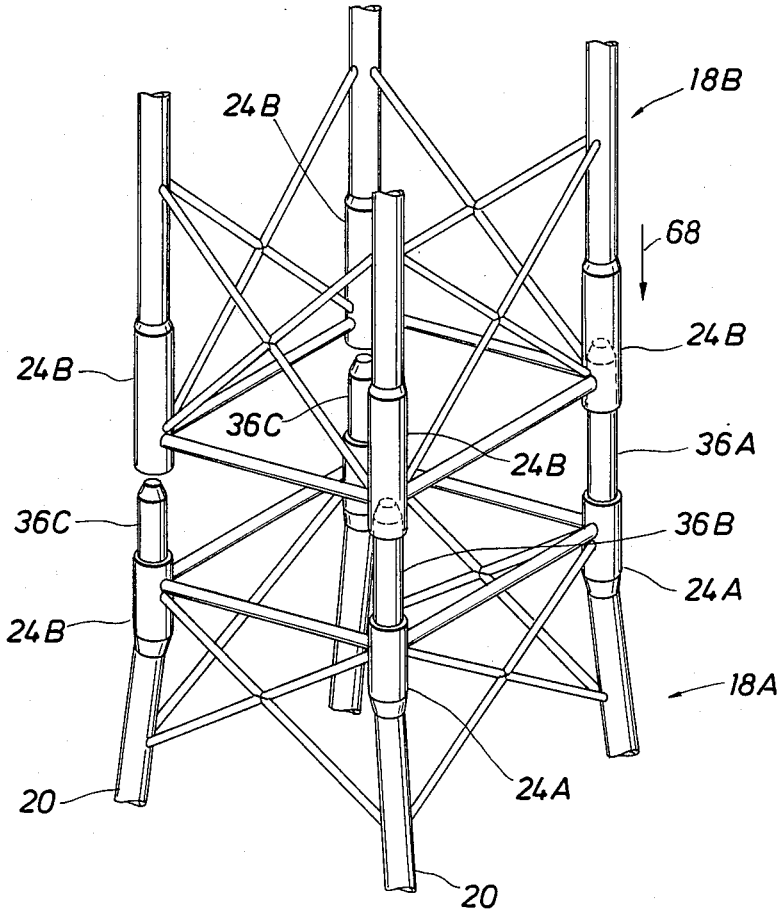
FIG. 12 is a perspective view of the mating of a jacket top section to the jacket bottom section at a stage in which the primary and secondary lead pins are engaged.

One or more of mating pins 36 may be lengthened to form lead pins 36A and 36B as illustrated in the embodiment of FIGS. 10-12. This preferred embodiment facilitates installation with an improved alignment method. Three different mating pin lengths have been set within jacket bottom section 18A in FIG. 10. These may be set into place in accordance with the description above. The longest mating pin, the primary lead pin, has a projected lead or extended length $l_1$, and is denoted with reference character 36A. Further, the preferred embodiment includes a secondary lead pin 36B having a projected lead extended length $l_2$ in addition to standard length mating pins 36C having total upward projected length $l_3$.

Jacket top section 18B is lowered until the corresponding downwardly open upper receptacle 24B initially engages primary lead pin 36A. See FIG. 11. This initial engagement serves as a pivot point for rotation of jacket top section 18B if any minor adjustments are needed. Arrow 66 denotes this rotation in FIG. 11.

With alignment assured, the jacket top section is further lowered and secondary lead pin 36B is stabbed such that further lowering secures and centers the primary and secondary lead pins within corresponding upper receptacles 24B of the jacket top section. See FIG. 12. This also secures very close alignment of the respective jacket section so that mating pins 36C should be in alignment for easy reception with their corresponding upper receptacles 24B upon further lowering of jacket top section 18B. See arrow 68 indicative of further lowering.

Note that in the embodiment of FIGS. 10-12 the leg portions 20 of the jacket bottom section are substantially splayed; however, both the upwardly open lower receptacles 24A and the downwardly open upper receptacles 24B are substantially vertical to allow vertical docking of the respective jacket sections.

Other modifications, changes and substitutions are intended in the foregoing disclosure and in some instances, some features of the invention will be employed without a corresponding use of other features. Accordingly, it is appropriate that the appended claims be construed broadly and in a manner consistent with the spirit and scope of the invention herein.

What is claimed is:

1. An offshore platform mating system for joining on site a prefabricated jacket upper section to a prefabricated jacket lower section in the installation of an offshore platform, said system comprising:

a plurality of upwardly open lower receptacles, each provided as an upper extension of one of a plurality of first leg portions of the jacket lower section;

a plurality of mating pins, each receivable within one of the lower receptacles to project upwardly a docking pole from the first leg portions of the jacket lower section;

a plurality of downwardly open upper receptacles, each provided as a lower extension of one of a plurality of second leg portions of the jacket upper section and disposed to receive one of the upwardly projecting docking poles; and means for securing the jacket upper section to the jacket lower section.

2. An offshore platform mating system in accordance with claim 1 wherein means for securing the jacket upper section to the jacket lower section comprises means for securing the jacket upper section to the jacket lower section about the mating pins.

3. An offshore platform mating system in accordance with claim 2 wherein means for securing the jacket upper section to the jacket lower section about the mating pins comprises means for injecting grout into the upper and lower receptacles and around the mating pins enclosed therein.

4. An offshore platform mating system in accordance with claim 1 wherein each first leg portion is provided with one of the upwardly open lower receptacles and wherein each of the second leg portions are provided with a downwardly open upper receptacle.

5. An offshore platform mating system in accordance with claim 1 wherein the docking pole portion of the mating pins terminates in an upwardly converging cone which aids alignment during docking operations.

6. An offshore platform mating system in accordance with claim 5 wherein the lower portions of the mating pins terminate in a downwardly converging cone.

7. An offshore platform mating system in accordance with claim 1 wherein the lower receptacles terminate in a substantially coplanar presentation and the upper receptacles terminate in a substantially coplanar presentation.

8. An offshore platform mating system in accordance with claim 7 wherein at least one of a first set of pairs of corresponding upper and lower receptacles is shortened a minimum amount sufficient to ensure that initial loading is concentrated across a second set of pairs of corresponding upper and lower receptacles.

9. An offshore platform mating system in accordance with claim 7 wherein one of the mating pins is extended to project upwardly further than the remaining mating pins thereby forming a primary lead pin.

10. An offshore platform mating system in accordance with claim 9 wherein another of the mating pins is extended to project upwardly a distance intermediate the primary lead pin and the remaining mating pins, thereby forming a secondary lead pin.

11. An offshore platform mating system in accordance with claim 1, further comprising additional stacked jacket sections wherein, at each junction of adjacent jacket sections, the adjacent jacket sections are joined as the jacket upper section and the jacket lower section as to that junction.

12. An offshore platform suitable for standing in a body of water and extending from a floor thereof to above a waterline, said offshore platform comprising:

A. a jacket lower section installed on the floor, comprising:
   (1) a plurality of first leg portions;
   (2) means for bracing the first leg portions connection therebetween;
   (3) a foundation securing the first leg portions to the floor;
   (4) a substantialy vertical upwardly open lower receptacle at the top of each of the first leg portions; and
   (5) a pin support across the bottom of each of the lower receptacles;

B. a plurality of substantially vertical, elongated, substantially cylindrical mating pins, each comprising:
   (1) a lower portion terminating in a downwardly converging conical section received within the lower receptacles and supported therein by the pin support;
   (2) a middle shank portion; and
   (3) an upper portion terminating in an upwardly converging conical section;

C. a jacket upper section mated above the jacket lower section, comprising:
   (1) a plurality of second leg portions corresponding in position to those of the first leg portions of the jacket lower section;
   (2) means for bracing the second leg portions of the jacket upper section connected therebetween;
   (3) a downwardly open upper receptacle at the lower end of the second leg portion in the jacket upper section receiving the upper portion of the mating pins;

D. means for securing the jacket top section to the jacket bottom section; and

E. a platform for conducting hydrocarbon recovery operations supported above the waterline on the jacket upper section.

13. An offshore platform constructed in accordance with claim 12 wherein means for securing the jacket upper section to the jacket lower section comprises means for injecting grout into the upper and lower receptacles around the mating pins enclosed therein.

14. An offshore platform constructed in accordance with claim 12 wherein one of the mating pins is a primary led pin which extends upwardly farther from reception in the corresponding lower receptacle than the other mating pins extend from the respective lower receptacle for each.

15. An offshore platform constructed in accordance with claim 14 wherein another of the mating pins forms a secondary lead pin which projects upwardly from reception within the corresponding lower receptacle further than the remaining mating pins but not so far as the primary lead pin.

16. A method for assembling an offshore platform upon a floor of a body of water, comprising:

A. securing a jacket lower section having a plurality of first-stage leg portions to the floor of the body of water;

B. installing a plurality of mating pins into a plurality of corresponding substantially vertical upwardly open lower receptacles presented upon the tops of the first-stage leg portions of the jacket lower section, the mating pins being installed so as to project a docking pole upwardly from the jacket lower section;

C. mating a jacket upper section to the jacket lower section by lowering a plurality of downwardly open upper receptacles presented on the lower end of second-stage leg portions over the docking poles and seating the jacket upper section upon the jacket lower section; and D. securing the jacket upper section to the jacket lower section.

17. A method for assembling an offshore platform in accordance with claim 16 wherein securing the jacket upper section to the jacket lower section comprises securing both the jacket upper section and the jacket lower section to the mating pins.

18. A method for assembling an offshore platform constructed in accordance with claim 17 wherein securing both the jacket upper section and the jacket lower section to the mating pins comprises injecting grout into an annular space within the upper and lower receptacles and surrounding the mating pins.

19. A method for assembling an offshore platform in accordance with claim 16 wherein the jacket upper section to the jacket lower section further comprises selecting the load distribution present upon initial touchdown of the jacket upper section on the jacket lower section by providing a first set of pairs of corresponding upper and lower receptacles in which at least one of the receptacales is shortened an amount sufficient to ensure that initial loading is concentrated across a second set of pairs of corresponding upper and lower receptacles.

20. A method for assembling an offshore platform in accordance with claim 16 wherein mating the jacket upper section to the jacket lower section further comprises:

lowering the downwardly open upper receptacles over the docking poles presented by the mating pins until an extended mating pin which forms a primary lead pin is engaged by the corrresponding upper receptacle;

realigning the jacket upper section with the jacket lower section as necessary to rotationally align the remaining mating pins with their corresponding upper receptacles by pivoting the jacket upper section about the engaged primary lead pin; and further lowering the downwardly open upper receptacles onto the docking poles until each is engaged.

21. A method for assembling an offshore platform in accordance with claim 20 wherein realigning the jacket upper section with the jacket lower section further comprises further lowering the downwardly open upper receptacles while monitoring the rotational alignment of the jacket top section until another extended mating pin which forms a secondary lead pin of a height intermediate to the primary lead pin and the remaining mating pins are engaged.

22. A method for assembling an offshore platform in accordance with claim 16 further comprising repeating steps B through D as set forth in claim 16 in which the last added jacket upper section becomes the jacket lower section for a succeeding jacket section installed.

23. A method for assembling an offshore platform upon a floor of a body of water, comprising:

A. securing a jacket lower section having a plurality of first-stage leg portions to the floor of the body of water;

B. installing a plurality of mating pins into a plurality of corresponding substantially vertical upwardly open lower receptacles presented upon the tops of the first-stage leg portions of the jacket lower section, the mating pins being installed so as to project a docking pole upwardly from the jacket bottom section; and C. mating a jacket upper section to the jacket bottom section by lowering a plurality of the downwardly open upper receptacles presented on the lower end of the second-stage leg portions over the docking poles and seating the jacket upper section upon the jacket lower section, said step comprising:

(1) lowering the downwardly open upper receptacles over the docking poles presented by the mating pins until an extended mating pin which forms a primary lead pin is engaged by the corresponding upper receptacle;

(2) realinging the jacket upper section with the jacket lower section as necessary to rotationally align the remaining mating pins with their corresponding upper receptacles by pivoting the jacket top section about the engaged primary lead pin;

(3) further lowering the downwardly open upper receptacles while monitoring the rotational alignment of the jacket upper section until another extended mating pin which forms a secondary lead pin of a height intermediate to the primary lead pin and the remaining mating pins is engaged; and (4) further lowering the downwardly open upper receptacles onto the docking poles until each is engaged; and (5) securing the jacket upper section to the jacket lower section by securing both the jacket upper section and the jacket lower section to the mating pins by means of injecting a grout into an annular space within the upper and lower receptacles and surrounding the mating pins.

24. An offshore platform mating system for joining on site a prefabricated jacket upper section to a prefabricated jacket lower section in the installation of an offshore platform, said system comprising:

a plurality of upwardly open lower receptacles, each provided as an upper extension of one of a plurality of first leg portions of the jacket lower section and each terminating in a substantially coplanar presentation;

a plurality of mating pins, each receivable within one of the lower receptacles to project upwardly a docking pole from the first leg portions of the jacket lower section;

a plurality of downwardly open upper receptacles, each provided as a lower extension of one of a plurality of second leg portions of the jacket upper section to terminate in a substantially coplanar presentation and in which each is disposed to receive one of the upwardly projecting docking poles, wherein at least one of the first set of pairs of corresponding upper and lower receptacles is shortened a minium amount sufficient to ensure that initial loading is concentrated across a second set of pairs of corresponding upper and lower receptacles; and means for securing the jacket upper section to the jacket lower section.

25. A method for assembling an offshore platform upon a floor of a body of water, comprising:

A. securing a jacket lower section having a plurality of first-stage leg portions to the floor of the body of water;

B. installing a plurality of mating pins into a plurality of corresponding substantially vertical upwardly open lower receptacles presented upon the tops of the first-stage leg portions of the jacket lower section, the mating pins being installed so as to project a docking pole upwardly from the jacket lower section;

C. mating a jacket upper section to the jacket lower section by lowering a plurality of the downwardly open upper receptacles presented on the lower end of the second-stage leg portions over the docking poles and seating the jacket upper section upon the jacket lower section, said mating the jacket upper section to the jacket lower section further comprising selecting the load distribution present upon initial touchdown of the jacket upper section on the jacket lower section by providing a first set of pairs of corresponding upper and lower receptacles in which at least one of the receptacles is shortened an amount sufficient to ensure that initial loading is concentrated across a second set of pairs of corresponding upper and lower receptacles;

D. Securing the jacket upper section to the jacket lower section.

* * * * *